United States Patent [19]

Weir

[11] 4,395,303

[45] Jul. 26, 1983

[54] METHOD OF MANUFACTURING THIN-WALLED CORROSION RESISTANT METALLIC OBJECTS

[75] Inventor: Charles R. Weir, Bloomfield Hills, Mich.

[73] Assignee: Masco Corporation, Taylor, Mich.

[21] Appl. No.: 256,003

[22] Filed: Apr. 22, 1981

[51] Int. Cl.[3] ..... C23F 1/02

[52] U.S. Cl. ..... 156/656; 156/628; 156/630; 156/645; 156/664; 228/125; 228/159; 228/193; 428/586; 428/593

[58] Field of Search ..... 148/6, 6.2, 4, 6.31, 148/6.35; 204/23, 25, 26, 27; 428/586, 593; 427/239, 376.8, 405, 383.9; 228/125, 157, 159, 181, 193, 195; 156/150, 151, 155, 656, 664–666, 628, 630, 645

[56] References Cited

U.S. PATENT DOCUMENTS

| | | | |
|---|---|---|---|
| 1,346,062 | 7/1920 | Ruder | 427/376.8 X |
| 2,607,983 | 8/1952 | McBride | 428/613 |
| 2,619,438 | 11/1952 | Varian et al. | 156/656 X |
| 2,752,731 | 7/1956 | Altosaar | 65/31 X |
| 3,261,733 | 7/1966 | Bellinger | 156/656 |
| 3,526,953 | 9/1970 | Levinstein | 228/193 X |
| 4,065,046 | 12/1977 | Roberts et al. | 156/656 X |

*Primary Examiner*—William A. Powell

*Attorney, Agent, or Firm*—E. Dennis O'Connor; Steven L. Permut; Leon E. Redman

[57] ABSTRACT

A method of manufacturing metallic objects having thin walls and comprised of corrosion resistant materials. The method has the consecutive steps of forming a workpiece in the shape of the desired end product from a metal having a low resistance to an etchant, forming within a surface of the workpiece a metallic alloy case resistant to the etchant and etching the workpiece with the etchant.

31 Claims, 38 Drawing Figures

METHOD OF MANUFACTURING THIN-WALLED CORROSION RESISTANT METALLIC OBJECTS

BACKGROUND

The present invention relates to a method for making corrosion resistant metallic objects having thin walls. The method is particularly useful for making small diameter stainless steel tubing for use in corrosive heat exchange environments and for making stainless steel structural honeycomb material.

Metallic heat exchangers having a large number of fluid passageways are in common use, for example in air conditioning systems, heat pumps and external combustion engines. A common problem with such heat exchangers is that the working fluid inside the heat exchanger and the environment outside the heat exchanger are often corrosive. After the heat exchanger has been in operation for a long period of time, the action of corrosive fluids on the metal of the heat exchanger may decrease the efficiency at which heat is transferred through the metal and may even cause leaks or blockages.

Corrosion resistant metals, such as stainless steel, may be used for such heat exchangers to avoid corrosion or to reduce the rate of corrosion. Unfortunately, however, most corrosion resistant materials do not conduct heat as efficiently as the corrodible metals that they would be replacing. Thus, production of an efficient heat exchanger using a corrosion resistant metal requires the use of fluid passageways having very thin walls. It is often expensive and difficult to produce stainless steel objects having very small passageways or very thin walls using currently known methods, particularly since stainless steel tends to crack when it is worked.

The primary object of the present invention is to provide an inexpensive method for producing corrosion resistant metallic objects having thin walls. A second object of the present invention is to provide a method of producing stainless steel tubing. A third object of the present invention is to provide a method to produce in a continuous process a large quantity of small diameter tubing having thin walls. Another object of the present invention is to provide an inexpensive method for producing stainless steel heat wheels having numerous small diameter passageways of a predetermined uniform small diameter. Still another object of the present invention is to provide a method of producing light weight stainless steel honeycomb material.

SUMMARY

The present invention provides a method of manufacturing metallic objects having thin walls and composed of corrosion resistant materials.

According to the method of the present invention, a metal having a low resistance to an etchant is formed into a workpiece having the shape of the desired end product. An alloy case composed of an alloy resistant to the etchant is formed to a predetermined depth in one or more surfaces of the workpiece. The portion of the workpiece that is not alloyed is then etched away from the alloy case using the etchant.

In the preferred embodiment, this method is used to form a stainless steel tube having a thin wall. Mild, low carbon steel wire is formed into the shape of the desired end product. A stainless steel case is formed on the cylindrical surface of the wire. The low carbon steel core of the wire then is removed by immersing the wire in nitric acid.

In a second embodiment, this method is used to form a stainless steel honeycomb structure. Several elongated low carbon steel workpieces are plated with chromium about their longitudinal surface. The workpieces are arranged into a closely packed array with their longitudinal axes parallel. The array of workpieces are heated to a temperature between about 1600° F. and the melting point of the steel. In that temperature range, the chromium will diffuse a predetermined depth into each of the workpieces and the adjacent surfaces of the workpieces will bond together. The low carbon core of each of the workpieces is then removed by immersing the array in nitric acid. The resulting stainless structure will have a passageway therethrough corresponding to each of the workpieces used.

BRIEF DESCRIPTION OF THE DRAWING

FIGS. 32 through 35 are views similar to FIGS. 30 and 31 but showing the array of workpieces thereof after the workpieces have been heated, cooled and etched according to the method of the present invention;

DETAILED DESCRIPTION OF THE PREFERRED EMBODIMENT

Figures 1, 2, 3, 4, 5, 6, 7, 8, 9, 10, 11, 12, 13, 14, 15, 16, 17, 18, 19, 20, 21, 25, 26, 27:
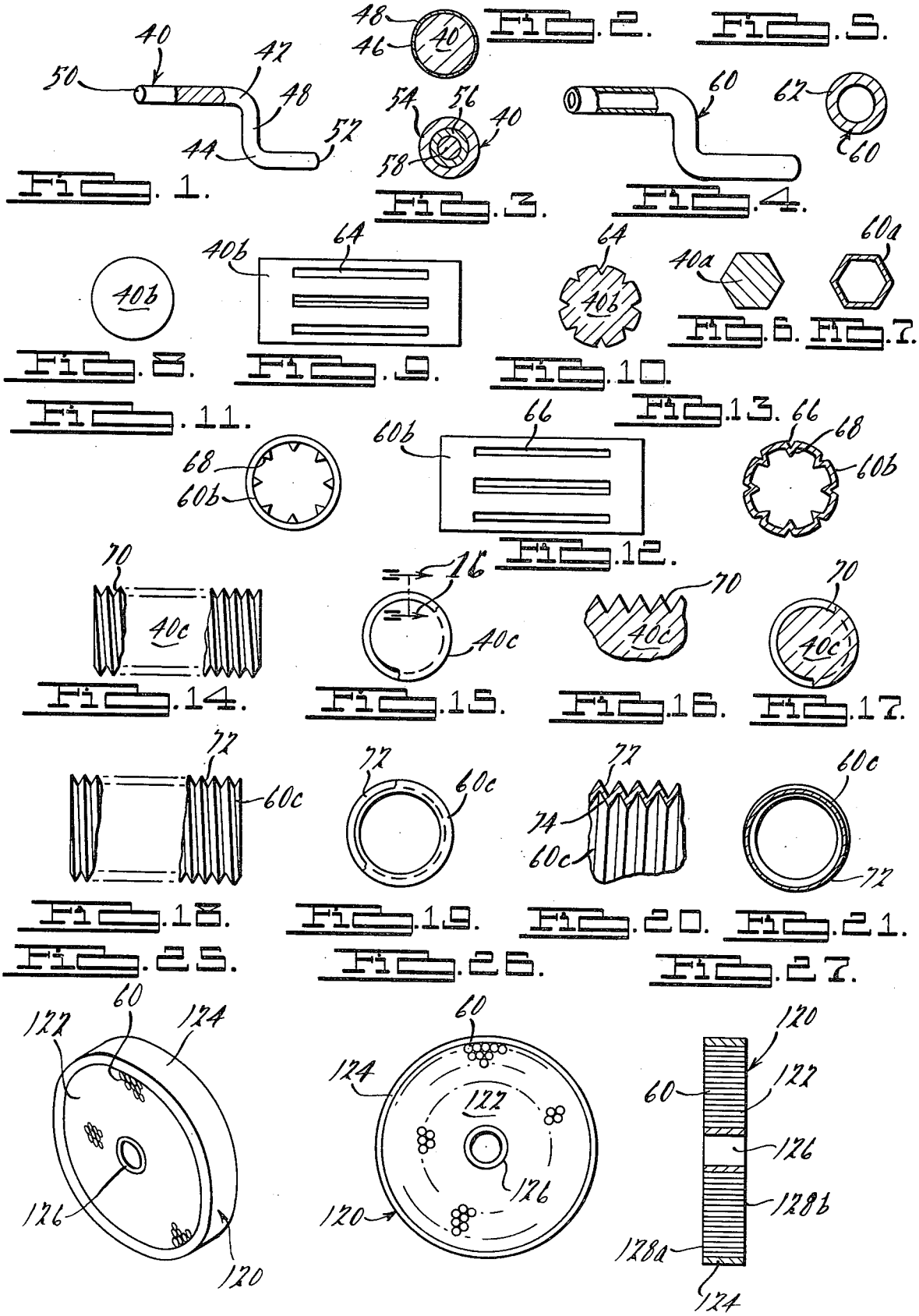
FIG. 1 is a partly cut-away perspective view of a length of corrodible metallic wire.
FIG. 2 is a cross-sectional view of the wire of FIG. 1 after deposition of an alloying metal on the surface thereof in accordance with the method of the present invention.
FIG. 3 is a cross-sectional view of the wire of FIG. 1 after a corrosion resistant alloy case has been formed on its surface in accordance with the method of the present invention.
FIG. 4 is a partly cut-away perspective view of a thin-walled stainless steel tube produced from the wire of FIG. 1 according to the method of the present invention.
FIG. 5 is a cross-sectional view of the tube of FIG. 4.
FIG. 6 is a cross-sectional view of a wire extruded into a uniform hexagonal cross-section.
FIG. 7 is a cross-sectional view of a tube produced from the wire of FIG. 6 by the method of the present invention.
FIG. 8 is an end view of a length of low carbon steel wire with a plurality of longitudinal grooves along its cylindrical surface.
FIGS. 9 and 10 provide a side view and a cross-sectional view, respectively, of the wire of FIG. 8.
FIGS. 11 through 13 are views similar to FIGS. 8 through 10, respectively, but showing a stainless steel tube produced from the wire of FIGS. 8 through 10 according to the method of the present invention.
FIG. 14 is a side view of a length of low carbon steel wire provided with an external screw thread.
FIG. 15 is an end view of the wire of FIG. 14.
FIG. 16 is a partial sectional view taken along lines 16—16 of FIG. 15.
FIG. 17 is a cross-sectional view of the wire of FIG. 14.
FIGS. 18 through 21 are views similar to FIGS. 14 through 17, respectively, but showing a stainless steel tube formed from the wire of FIGS. 14 through 17 according to the method of the present invention.
FIG. 25 is a perspective view of a heat wheel made according to the method of the present invention.
FIG. 26 is a front elevational view of the heat wheel of FIG. 25.
FIG. 27 is a sectional view taken along line 27—27 of FIG. 26.

The many objects, features and advantages of the present invention will become apparent to those skilled in the art when the following detailed description of the preferred embodiment is read together with the attached drawings. Some of the drawings are intentionally drawn out of scale for illustrative purposes.

Referring to the drawing, a workpiece is formed into any desired shape. In the first embodiment, shown in FIG. 1, the workpiece is a short length of wire 40 having two bends 42 and 44. For reasons that will be described shortly, the wire is preferably small. A recommended size for the wire 40 is less than one foot or about one third of a meter in length and from thirty thousandths of an inch to two inches (0.03" to 2.0") or from about three quarters of a millimeter to fifty millimeters (0.75 mm to 50.0 mm) in diameter.

The wire workpiece 40 is comprised of a low carbon steel preferably having a carbon content of less than two tenths of one percent (0.2%), corresponding to A.I.S.I. 1020 steel. Low carbon steel is preferred because some of the chromium that is diffused into the steel according to the method described below will form chromium carbide which inhibits absorption of additional chromium. As the carbon content of the steel is increased, the amount of chromium that the steel will absorb is decreased and the corrosion resistance of the stainless steel produced from the steel is decreased. Furthermore, the lower the carbon content of the steel, the deeper chromium will penetrate. Steel having a carbon content of less than two tenths of one percent (0.2%) will absorb a sufficient amount of chromium to produce a stainless steel case that will be useful in producing tubing according to the present invention. In the extreme case, pure iron may be used. When pure iron is used, the thickness of the stainless steel case produced by the method described below will be a function of the thickness of the chrome plating, the temperature of the furnace and the time the workpiece is held within it.

For some applications, however, a steel having a higher carbon content may be preferable. For example, where wear resistance is more critical than corrosion resistance, a higher carbon content steel should be considered since it will produce a less ductile stainless steel case.

According to the method of the present invention, a thin layer 46 of chromium is deposited on the cylindrical outer surface 48 of the wire workpiece 40, as shown in FIG. 2. This may be done by any one of the several means well known in the art such as direct chrome plating, sputtering, iron vapor deposition, and vacuum metalizing. The thickness of the chromium plating will be from one tenth thousandth to one thousandth of an inch (0.0001" to 0.0001") or from about three to thirty microns (0.003 mm to 0.03 mm thick. The end faces 50 and 52 are shielded during the plating operation or, alternatively, are plated when the cylindrical surface is plated and then are ground to remove the plating.

The wire workpiece 40 is then heated in a furnace to a temperature above approximately sixteen hundred degrees Fahrenheit (1600° F.) or eight hundred and seventy degrees Celsius (870° C.) and below twenty-six hundred degrees Fahrenheit (2600° F.) or fourteen hundred degrees Celsius (1400° C.). This is done in the presence of a protective atmosphere, such as hydrogen, or in an appropriate level of vacuum to prevent oxidation of the metallic surfaces. As is well known in the art, in this temperature range the chromium will diffuse into the plated surface. It should be noted that the exact temperature of the furnace is not critical to the formation of the stainless steel case. The process of chromium absorption in the steel starts at about sixteen hundred degrees Fahrenheit (1600° F.) but will occur more rapidly and more uniformly at higher temperatures. So long as a temperature of the wire workpiece 40 is kept below the melting temperature of the steel, around twenty-six hundred degrees Fahrenheit (2600° F.), the depth of the surface region will be thin and even. The use of a temperature close to the melting temperature of the steel is preferable since the diffusion process will be complete in a matter of minutes at higher temperatures but will take several hours at the lower temperatures.

The chromium diffuses into the surface of the wire workpiece 40 at a rate dependent on the temperature of the furnace. As the chromium is diffused into the wire, a surface region 54 of the wire workpiece 40, illustrated in FIG. 3, absorbs chromium in the form of an iron chromium alloy and thereby forms a stainless steel having a chromium content in excess of twelve percent (12%). The surface region 54 is from five ten thousandths to two thousandths of an inch (0.0005" to 0.002") or from fifteen to fifty microns (0.015 mm to 0.050 mm) thick. In a boundary region 56 below the stainless steel surface region 54, a large quantity of chromium carbide is developed. The chromium carbide inhibits the further migration of chromium into the core 58 of the wire workpiece 40.

The wire workpiece 40 is allowed to cool in the presence of the protective atmosphere below about seven hundred degrees Fahrenheit (700° F.), or about three hundred and seventy degrees Celsius (370° C.), to prevent oxidation of surfaces of the wire workpiece 40. Alternatively, the wire workpiece 40 maybe quenched to below that temperature to prevent the surface from oxidizing.

After the wire workpiece 40 has been cooled, the wire is immersed in a bath containing nitric acid. The acid will etch the steel material that has less than about a twelve percent (12%) chromium content. Thus, the acid will etch the material in the boundary region 56 and the core 58 of the wire workpiece 40. The etching process leaves the stainless steel surface region 54 intact and thus produces a tubular end product 60 shown in FIGS. 4 and 5. The tubular end product 60 has an annular wall about five ten thousandths to two thousandths of an inch (0.0005" to 0.002") or from fifteen to fifty microns (0.015 mm to 0.050 mm) thick.

As mentioned earlier, a wire workpiece 40 having a small diameter is best suited for the method of the present invention. This is true since conventional methods may be more economical for the production of larger diameter tubes 60. Short lengths of tubing are also preferable since the acid must be able to etch through the core of the wire along its entire length. The smaller the diameter of the wire workpiece 40, the more difficulty the acid will have etching deeply into the core of the wire. For longer wires, agitating the acid will facilitate the etching process. Alternatively, the wire may be immersed in an acid bath and in a water rinsing bath several times.

FIGS. 6 through 21 illustrate alternative workpieces 40*a*, 40*b* and 40*c* that may be used in carrying out the method of the present invention and also illustrate the end products 60*a*, 60*b* and 60*c* that are produced from these workpieces. The variations in the workpieces illustrated result in an increase or a decrease in the surface areas of the tubular end product. These modifications thereby vary the rate at which heat will be transferred between the fluid within the tube and the surrounding environment. The variations in the cross-sectional shape of the workpiece also affect the strength of the tube produced.

Referring to FIG. 6, the wire workpiece 40*a* may be extruded into any cross-sectional shape, such as the hexagonal cross-section illustrated. The tubular end product will be a thin-walled hexagonal tube 60*a* having the cross-section illustrated in FIG. 7. Other cross-sectional shapes may be produced in this manner such as elipses, stars or other polygonal shapes.

Referring to FIGS. 8, 9 and 10, the wire workpiece 40*b* may be provided with several longitudinal slots 64 that are milled into its cylindrical surface. Alternatively, the slots may be closer together than those illustrated and may be knurled into the surface of the wire. In one example, the slots have a depth of four thousandths of an inch (0.004") or one hundred microns (0.1 mm). The tubular end product 60*b*, shown in FIGS. 11, 12 and 13, has external slots 66 and internal ribs 68 where the slots 64 were cut.

Referring to FIGS. 14 through 17, the wire workpiece 40*c* may be provided with a screw thread 70 on its cylindrical surface. The tubular end product 60*c*, shown in FIGS. 18 through 21, will have an external spiral rib 72 and an internal spiral rib 74.

Figures 22, 23, 24:
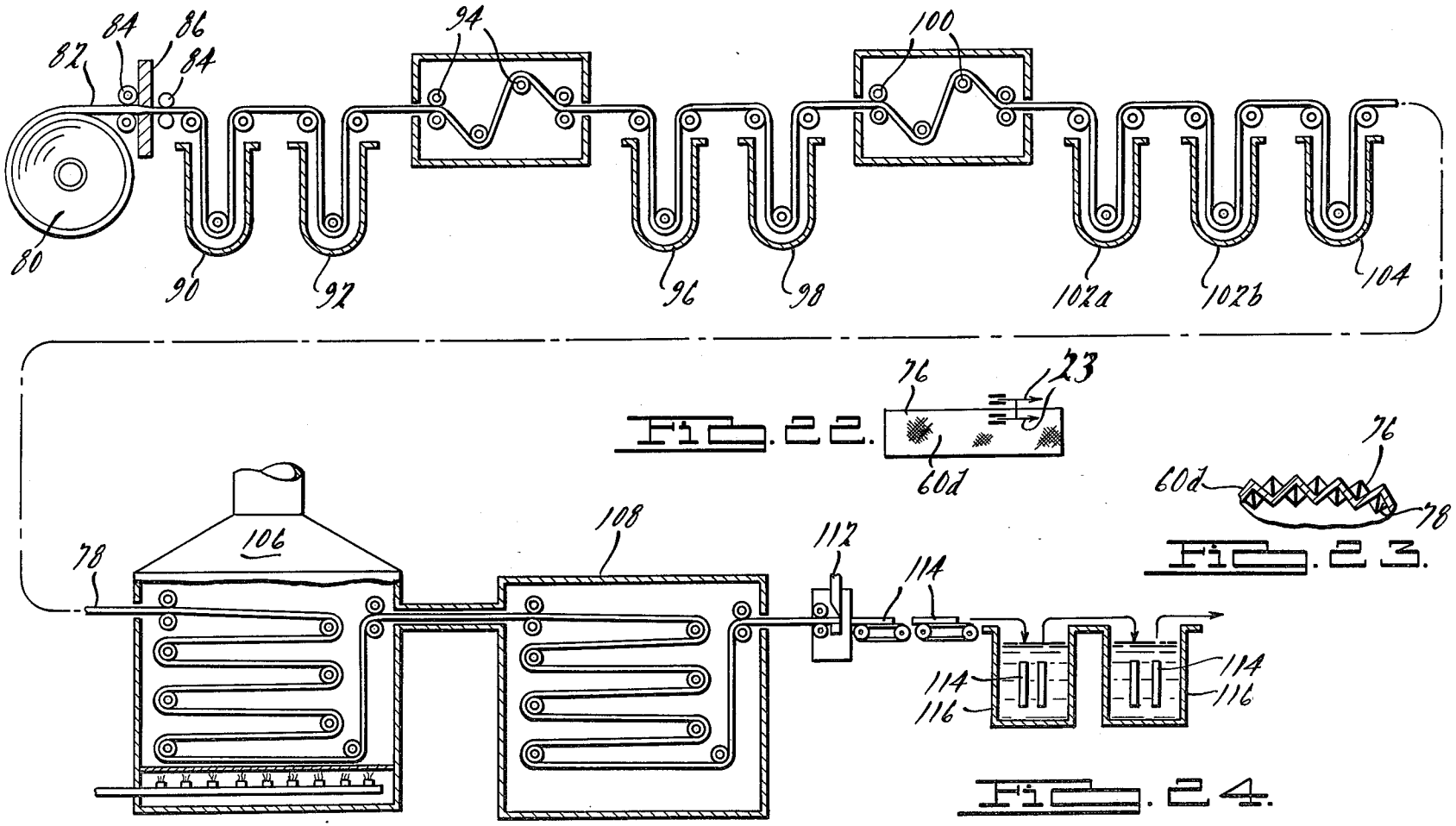
FIG. 22 is a side view of a tube made from a wire having diagonal knurling about its longitudinal surface.
FIG. 23 is an enlarged partial sectional view taken along lines 23—23 of FIG. 22.
FIG. 24 is a schematic view of an example of an assembly line used to continuously produce lengths of tubing according to the present invention.

FIGS. 22 and 23 illustrate a tube 60*d* that is made from a workpiece having crossing diagonal knurling on its peripheral longitudinal surface. Using the method of the present invention, the tubing 60*d* produced from diagonally knurled tubing has numerous pyramidal projections 76 on its outer surface. Each projection 76 has below it a corresponding pyramidal depression 78 in the inner surface of the tube 60*d*.

There are several other ways, not shown in the drawing, that the wire workpiece 40 may be modified to vary the heat transfer characteristics or the strength of the tubing. For example, the wire may be flattened to produce an eliptical cross-section. If a large diameter wire is used one or more small holes may be drilled transversely through the axis of the wire to produce columns or spokes to strengthen the tube. For example, if the wire has a diameter of more than a quarter of an inch (0.25") or about six and a half millimeters (6.25 mm), an axial hole through the wire having a diameter of less than an eighth of an inch (0.125") or about three millimeters (3 mm) will provide a hollow spoke through the tube that adds substantially to the strength of the tube.

Other methods known in the art may be used in place of the plating and heating operations described above to produce the stainless steel case in a single operation. Examples of such methods include pack cementation, molten salt bath chromizing and gaseous diffusion. Gaseous diffusion is particularly useful when the workpiece has small slots or passageways that are difficult or impossible to plate.

FIG. 24 schematically illustrates a method by which tubular end products 60 may be continuously, rapidly and economically produced. A spool 80 supplies a length of wire 82 to a shaping station. The shaping station shapes the wire 82 into any desired cross-section by extruding, milling or knurling the wire 82. In the drawing, rollers 84 draw the wire 82 through a draw plate 86 to extrude the wire to a chosen cross-sectional shape.

The wire 82 is directed by rollers from the shaping station to a series of cleansing and brushing stations. The wire 82 is first immersed in a bath 90 containing a solvent to remove grease from the surface of the wire. Next, the wire 82 is immersed in a water bath 92 to remove the solvent. The surface of the wire is then brushed by a set of rollers 94 to smooth the surface. Next, the wire is immersed in a pickling bath 96 containing a mild acid, such as dilute hydrochloric acid or sulfuric acid, to remove any oxide film from the surface. The wire 82 is then rinsed in another water bath 98 and brushed by a second set of rollers 100.

The wire 82 is directed by rollers from the cleansing and brushing stations to a plating station. The wire 82 is immersed in two electroplating baths 102*a* and 102*b* containing chromic acid, as is well known in the art, to produce a thin chromium coating on the surface of the wire. After the plating has been completed, the wire 82 is rinsed in a water bath 104.

The wire 82 is directed from the plating station to a furnace 106 wherein the wire is heated to the desired temperature for the diffusion process to occur. The wire 82 is directed from the furnace 106 to a cooling station 108 where the wire is cooled in the presence of a protective atmosphere to prevent oxidation. From the cooling station 108, the wire is directed to a cutting station 110 where a blade 112 intermittingly cuts the wire 82 into lengths of wire 114. The lengths of wire 114 are transported to an etching bath 116 containing nitric acid, and then to rinsing station 118 containing water.

FIGS. 25 through 27 illustrate a regenerator or heat wheel 120 that may be produced using the method described above. Heat wheels are most often used in large generator systems to permit the use of heat from exhaust gasses to preheat incoming air.

The heat wheel 120 may be produced from tubes 60 made from straight wire in the manner described above.

Several of tubes 60 are silver or copper braised together to form an array 122 of small diameter tubes. An outer ring 124 and an inner ring or hub 126 are braised to the array 122. The end faces 128*a* and 128*b* (FIG. 27) are then ground flat. To reduce the tendency of the tubes to become blocked during the grinding operation, the tubes are filled with water and the water is cooled to form ice prior to beginning the grinding operation.

Figure 28:
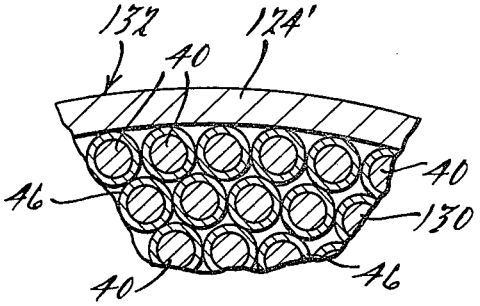
FIG. 28 is an enlarged partial elevational view of an array of workpieces used to produce the heat wheel of FIGS. 25 through 27.

An alternate method of producing the heat wheel 120 described above is provided by the present invention. FIG. 28 is a partial view illustrating an array 130 of wire workpieces 40 that may be used to produce a heat wheel 120. Several wire workpieces 40 of equal length are individually plated with chromium. The plated workpieces are arranged in a parallel array 130 and are loosely secured between a stainless steel outer ring 124' and a stainless steel hub (not shown) to form a wheel 132.

The wheel 132 is heated as described above to permit the layer 46 of chromium to diffuse into the cylindrical surfaces of each wire. The heat will simultaneously bond the touching sufaces of adjacent wires together. Note that the bonding between workpieces produced by this process is light and has less strength than the substitute of stainless steel. Under certain shearing loads the workpieces will separate.

After the wheel 132 has been cooled, the end faces may be ground flat, if necessary. Finally, the wheel 132 is immersed in a nitric acid bath. The nitric acid etches the core of each of the wires and thus produces a stainless steel heat wheel having a large number of small parallel passageways.

For most applications, the outer rim 124' of the wheel 132 is from one to three feet (1' to 3') or from one quarter meter to one meter (0.25 mm to 1 mm) in diameter and from one to six inches (1.0" to 6.0") or from 25 to 150 millimeter thick (25 mm to 150 mm). The wire workpieces 40 have diameters between thirty thousandths of an inch and half an inch (0.030" and 0.5") or between three quarters of a millimeter and thirteen millimeters (0.75 mm 13.0 mm).

Figure 29:
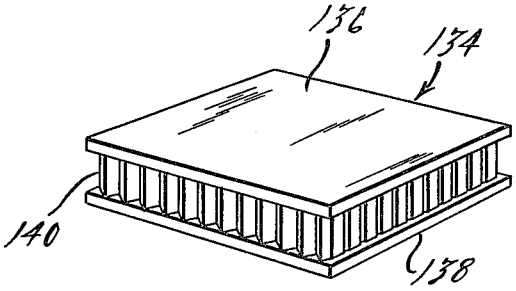
FIG. 29 is a perspective view of a piece of stainless steel structural honeycomb material produced using the present invention.

FIG. 29 illustrates a piece 134 of stainless steel structural honeycomb material that may be produced according to of the method of the present invention. The use of structural honeycomb material is well known in the art where a strong structure having a low weight is needed. The structural honeycomb consists of two thin outer sheets 136 and 138 and an inner honeycomb portion 140 having numerous parallel passageways.

Figure 30:
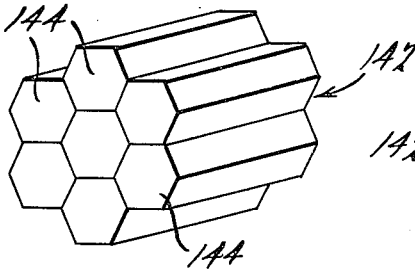
FIG. 30 is a perspective view of an array of workpieces used to produce the honeycomb of FIG. 29.
Figure 31:
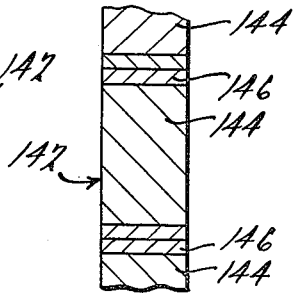
FIGS. 31 and 32 are each partial sectional views taken vertically through the workpieces of FIG. 30.
Figure 32:
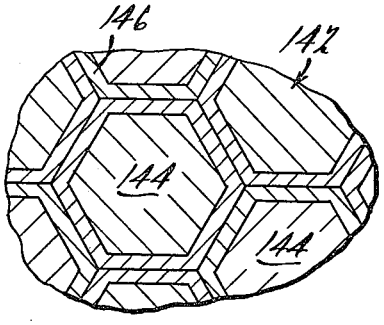

FIGS. 30 through 32 show an array 142 of workpieces 144 from which the inner honeycomb portion 140 may be produced. Each of the workpieces 144 is a right parallelepiped composed of a low carbon steel. In the drawing, the workpieces are hexagonal in cross-section but other convenient cross-sectional shapes can be used. For example, the cross-section may be rectangular, triangular, "C"-shaped, "L"-shaped or "I"-shaped. Each of the workpieces 144 has been separately plated with a layer of chromium 146 (FIGS. 31 and 32) about its entire longitudinal surface. The workpieces 144 are arranged with their longitudinal axes parallel to each other and with their longitudinal surfaces in contact with each other.

Figure 33:
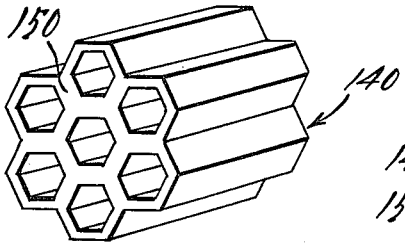
Figure 34:
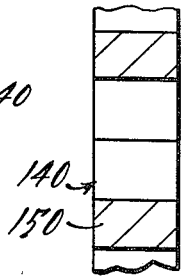
Figure 35:
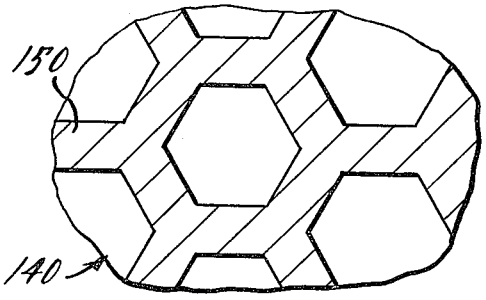

The array 142 is heated as a unit and then etched as described above to produce the honeycomb structure 140 illustrated in FIGS. 33 through 35. It should be noted that the thickness of the walls 150 will be double the stainless steel case thickness since each wall 150 is formed from adjacent surfaces of two workpieces 144. The honeycomb structure 140 is subsequently silver or copper braised to thin sheets of metal 136 and 138 to produce the structural honeycomb material 134 of FIG. 29.

The resulting honeycomb structure will weigh substantially less than a solid stainless steel plate of the same size. The ratio of the weight of the honeycomb structure to the weight of a solid plate of the same size will be approximately double the ratio of the wall thickness to the diagonal measurement of the workpiece used. This formula is approximately true whenever the cross-section of the workpiece are regular polygons or are circles. For example, the workpieces 40 may have a diagonal measurement of about thirty thousandths of an inch (0.03") or about three quarters of a millimeter (0.75 mm). Adjacent workpieces may produce walls having a thickness of about four thousandths of an inch (0.004") or about one tenth of a micron (0.1 mm). The honeycomb structure produced by these workpieces will weigh only one quarter (25%) as much as a solid stainless steel structure of the same size.

It should be noted that several sheets of structural honeycomb material or several heat wheels may be formed from the same array of workpieces. For example, if the workpieces are six inches (6.0") or about one hundred and fifty millimeters (150.0 mm) long, the array can be sliced into six sheets of structural honeycomb material or six heat wheels having a thickness of one inch (1.0") or about twenty-five millimeters (25.0 mm). The array of workpieces should be sliced after the array has been heated and cooled but before it has been etched.

Figure 36:
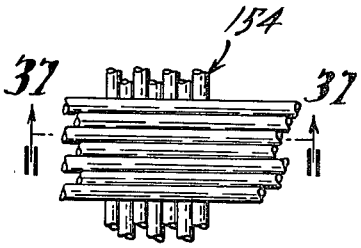
FIG. 36 is a stop view of a cross flow heat exchanger produced from several workpieces according to the present invention.
Figure 37:
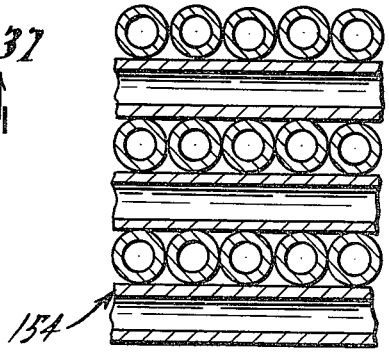
FIG. 37 is a sectional view taken along lines 37—37 of FIG. 36.
Figure 38:
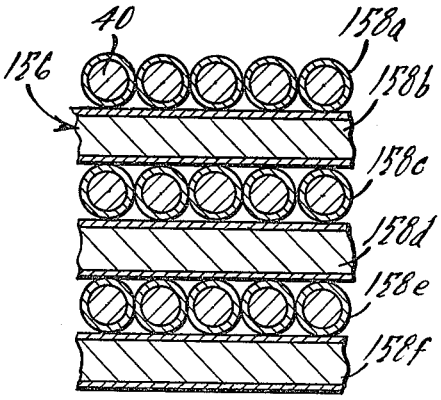
FIG. 38 is a view similar to FIG. 37 but showing the array of workpieces used to produce the heat exchanger of FIGS. 36 and 37.

FIGS. 36 and 37 illustrate a cross flow heat exchanger 154 that may be produced by the method of the present invention. Several steel wire workpieces 40 are individually plated with chromium. The workpieces 40 are arranged in an array 156, shown in FIG. 38, consisting of six alternating horizontal layers 158*a* through 158*f*. Within each of the layers 158*a* through 158*d*, the wire workpieces 40 are disposed parallel to each other. Each of the layers 158*a* through 158*f* is oriented at a right angle to the orientation of the layers adjacent to it. As described above, the array 156 is heated and etched to produce the heat exchanger 154.

The above-described method is not limited to use of low carbon steel or pure iron as a starting metal, chromium as an alloying metal or nitric acid as an etchant. For example, corrosion resistant tubing may be produced by diffusing nickel into the surface of a copper wire to produce a thin cylindrical case of monel. Sulfuric acid is used as an etchant to remove the pure copper core in this example.

Many other starting metals exist and are well known in the art that have a low resistance to a particular etchant, including alkaline etchants and saline etchants as well as acid etchants. Many of these starting metals can be alloyed with another metal to produce an alloy resistant to the etchant. The process used to produce the corrosion resistant case will be different for other starting metals but the processes are well known in the art. The use of different materials will produce end products having different characteristics. For example, varying the starting metal and the alloying metal may vary the type of corrosive environment to which the metallic end product will be resistant, the thickness of the metallic alloy case, the cost of manufacturing the end product, and the strength of the bond formed between adjacent workpieces. In addition, it may vary the strength, ductilty, weight, heat conductivity and electrical conductivity of the end product. Additional examples of starting metals and alloying metals that may be used together are nickel alloyed with steel, copper alloyed with zinc, silicon alloyed with aluminum, nickel and chromium alloyed with steel and chromium alloyed with copper.

From the above, it is apparent that the present invention provides an inexpensive method for producing corrosion resistant metallic objects having thin walls. The method is particularly useful for producing stainless steel tubing. The tubing may be produced in a rapid and continuous process. The present invention further provides a method of producing stainless steel heat wheel and light weight stainless steel structural honeycomb material. The present invention may also be used to produce thin-walled corrosion resistant metallic objects having ornamental value.

The above description of the present invention is intended by way of example and not by way of limitation and includes the best most contemplated by the inventor at the time of filing for carrying out the invention. Other embodiments of the invention will be apparent to those skilled in the art from a consideration of this specification or from practice of the invention disclosed herein. The scope and spirit of the present invention is indicated and limited only by the scope of the appended claims.

What is claimed as novel is as follows:

1. A method of making a thin-walled corrosion resistant end product from a workpiece comprised of a starting metal not resistant to an etchant and from an alloying metal which is selectively soluble in said starting metal to produce an alloy metal impervious to said etchant, the method comprising the consecutive steps of forming said workpiece into the shape of said end product, forming an alloy case of said alloy metal on a surface of said workpiece, and exposing said workpiece to said etchant to remove the portion of said workpiece which is not alloyed.

2. The method of claim 1 wherein said workpiece is a length of wire bent into the shape of a desired tubing end product and wherein said corrosion resistant alloy case is formed on the outer cylindrical surface of the wire and is not formed on the end surfaces of said wire; whereby said end product is a thin-walled corrosion resistant tube.

3. The method of claim 2 wherein said starting metal is copper, wherein said etchant is sulfuric acid, wherein said alloying metal is nickel and wherein said alloy metal is monel.

4. The method of claim 2 further comprising an additional step prior to forming said case, said additional step consisting of milling a slot in the surface of said wire; whereby said tube has a fin where said surface was milled.

5. The method of claim 2 wherein said wire has an external screw thread, whereby said tube has a spiral rib about both its outer cylindrical surface and its inner cylindrical surface.

6. The method of claim 2 wherein said wire has knurling on its cylindrical surface whereby said tube has pyrimidal contours on its outer and inner cylindrical surfaces.

7. The method of claim 2 wherein said wire is comprised of low carbon steel, wherein said etchant is nitric acid and wherein said alloy metal is stainless steel.

8. The method of making a thin-walled stainless steel tube of claim 7 wherein said case is formed on said wire by the consecutive steps of plating chromium on the surface of said wire and heating said wire to a temperature above that at which diffusion of chromium into steel occurs, and below the melting temperature of said wire.

9. The method of claim 8 wherein several of said low carbon steel wire workpieces are used, wherein each of said wires has its cylindrical surface plated with chromium and wherein each of said wires has a portion of its plated surface touching the plated surface of another of said wires during said heating step; whereby said wire workpieces fuse together during said heating step.

10. The method of claim 2 wherein said wire is less than one foot long and less than one half of an inch thick.

11. The method of claim 2 wherein said wire has a diameter of between thirty thousandths of an inch (0.030") and two inches (2.0").

12. The method of claim 1 wherein said starting metal is pure iron, wherein said etchant is nitric acid, and wherein said alloying metal is chromium.

13. The method of claim 1 wherein said starting metal is copper, wherein said etchant is sulfuric acid, wherein said alloying metal is nickel and wherein said alloy metal is monel.

14. The method of claim 1 wherein said case is formed on said workpiece by the consecutive steps of plating an alloying metal on said surface of said workpiece and heating said workpiece to a temperature above the temperature at which said alloying metal will begin to diffuse into said starting metal to produce a corrosion resistant alloy layer but to a temperature below the melting temperature of the metal.

15. The method of claim 14 wherein at least two of said workpieces are used, wherein each of said workpieces has a surface plated with said alloying material and wherein a portion of said plated surface of each of said workpieces is touching a portion of said plated surface of any other of said workpieces during said heating step; whereby said workpieces are welded together by said heating step.

16. A method of making a thin-walled corrosion resistant end product, the method comprising the consecutive steps of forming a low carbon steel workpiece into the shape of said end product, forming an acid resistant alloy case on a surface of said steel workpiece, and etching said workpiece with an acid which will dissolve the steel but to which the alloy case is impervious.

17. The method of claim 16 wherein said steel has a carbon content of less than 0.2%.

18. The method of claim 16 wherein said acid resistant alloy is a form of stainless steel.

19. The method of claim 18 wherein said stainless steel case is produced by the consecutive steps of plating chromium on said surface of said workpiece, and heating said workpiece to a temperature at which the chromium will diffuse into said surface.

20. The method of claim 19 wherein said chromium is plated on said surface by electrodeposition.

21. The method of claim 16 wherein said acid is nitric acid.

22. A method of continuously making thin-walled corrosion resistant tubing, the method comprising the simultaneous steps of supplying a portion of a continuous line of a metallic wire comprised of a starting metal to a plating station, continuously plating said portion of said wire in said plating station with an alloying metal, continuously feeding a portion of said wire from said plating station into a furnace, continuously heating said portion of said wire in said furnace at a temperature between the temperature at which said alloying material alloys with said starting metal and the melting temperature of said wire, maintaining said wire within said furnace until said alloying material has diffused into the surface of said wire to produce an alloy metal case of a predetermined depth; continuously feeding a portion of said wire from said furnace to a cutting station, intermittingly cutting said portion of said wire at said cutting station into predetermined lengths of wire, said method further comprising the step for each of said lengths of wire of etching said lengths of wire with an etchant to which said starting metal is not resistant but to which said alloy metal is resistant.

23. The method of claim 22 further comprising the additional steps of continuously supplying an untreated portion of said steel wire to a degreasing station, continuously cleansing said portion of said steel wire in said cleansing station in a solvent and continuously feeding a portion of said steel wire from said cleansing station to said plating station.

24. The method of claim 22 further comprising the additional steps of continuously supplying an untreated portion of said steel wire to a pickling station, continuously cleansing the portion of said steel wire in said pickling station with a mild acid, and continuously feeding a portion of said steel wire from said cleansing station to said plating station.

25. The method of claim 22 further comprising the additional steps of continuously supplying a portion of said wire to an extruder continuously feeding said portion of said wire through said extruder to produce a desired cross-section for said wire, and continuously feeding a portion of said wire from said extruder to said plating station.

26. The method of claim 22 wherein said metal is low carbon steel, said alloying metal is chromium, and said alloy is stainless steel.

27. A method of producing a corrosion resistant end product having a plurality of parallel passageways therethrough from at least three elongated workpieces comprised of a first metal having a low resistance to acid, said method comprising the consecutive steps of:

plating an alloying metal on the outer longitudinal surface of each of said workpieces;

arranging said workpieces in an array wherein the longitudinal axis of the workpieces are parallel to each other and wherein each of said workpieces is in contact along its outer longitudinal surface with the outer longitudinal surface of at least one of the other workpieces;

heating said array of workpieces in the presence of a protective atmosphere to a temperature above the temperature at which said alloying metal will diffuse into said first metal and below the melting temperature of said first metal;

maintaining said array at said temperature until said diffusion of said alloying metal into said first metal has produced a boundary layer of an alloying metal having a predetermined thickness and until said portions of said outer surfaces of said adjacent workpieces have bonded together;

maintaining said array in said protective atmosphere while cooling said array to a temperature at which the ambient atmosphere will no longer oxidize said alloying metal; and etching the remaining unalloyed portion of said first metal from said array with an etchant that will dissolve said first metal but will not dissolve said alloy metal.

28. The method of claim 27 wherein each of said workpieces is a wire of less than three inches in length and of less than half of an inch diameter, whereby said end product is a metallic structure having several small parallel and uniform passageways.

29. The method of claim 27 wherein each of said workpieces is comprised of low carbon steel and wherein said alloying metal is chromium, whereby said alloy metal is stainless steel.

30. The method of claim 27 wherein said workpieces are parallelepipeds whereby said end product is a metallic honeycomb structure.

31. The method of claim 27 wherein each of said workpieces is comprised of copper and wherein said alloying metal is nickel, whereby said alloy metal is monel.

* * * * *